US006932508B2

(12) United States Patent
Isai

(10) Patent No.: US 6,932,508 B2
(45) Date of Patent: Aug. 23, 2005

(54) POSITIVE VALVE CLOSURE FOR PLASTIC-LINED BAGS AND METHOD FOR MAKING SAME

(75) Inventor: Neculai Roland Isai, Richmond Hill (CA)

(73) Assignee: Smurfit-Stone Container Enterprises, Inc., Chicago, IL (US)

( * ) Notice: Subject to any disclaimer, the term of this patent is extended or adjusted under 35 U.S.C. 154(b) by 0 days.

(21) Appl. No.: 10/325,548

(22) Filed: Dec. 20, 2002

(65) Prior Publication Data

US 2004/0120609 A1 Jun. 24, 2004

(51) Int. Cl.[7] ..... B65D 33/24
(52) U.S. Cl. ..... 383/48; 383/52
(58) Field of Search ..... 383/52, 48

(56) References Cited

U.S. PATENT DOCUMENTS

| | | | | |
|---|---|---|---|---|
| 1,809,259 A | | 6/1931 | Williams | |
| 3,040,967 A | * | 6/1962 | Ernest | 383/52 |
| 3,092,303 A | * | 6/1963 | Woerner | 383/52 |
| 3,167,241 A | * | 1/1965 | Woerner | 383/52 |
| 3,410,300 A | | 11/1968 | Mondano | |
| 3,549,298 A | | 12/1970 | Brockmüller | |
| 4,049,191 A | | 9/1977 | Stearley | |
| 4,071,187 A | * | 1/1978 | LaFleur | 383/45 |
| 4,524,460 A | | 6/1985 | Twiehoff et al. | |
| 4,566,131 A | | 1/1986 | Achelpohl | |
| 4,686,814 A | | 8/1987 | Yanase | |
| 4,708,705 A | | 11/1987 | Aubry et al. | |
| 4,759,640 A | | 7/1988 | Gröner | |
| 5,121,996 A | | 6/1992 | Scarrow | |
| 5,701,996 A | | 12/1997 | Goto et al. | |
| 6,012,844 A | | 1/2000 | Huseman et al. | |
| 6,013,018 A | | 1/2000 | Bannister | |
| 6,126,316 A | | 10/2000 | Bannister | |
| 6,156,363 A | | 12/2000 | Chen et al. | |
| 6,164,823 A | | 12/2000 | Donnell | |
| 2002/0164090 A1 | | 11/2002 | Schneck | |
| 2002/0164091 A1 | | 11/2002 | Schneck | |
| 2002/0164092 A1 | | 11/2002 | Schneck | |

FOREIGN PATENT DOCUMENTS

| | | |
|---|---|---|
| DE | 36 32 024 A1 | 4/1988 |
| FR | 2 651 748 | 3/1991 |
| GB | 2 046 696 A | 11/1980 |
| JP | 1-199856 | 8/1989 |
| JP | 2001-233353 | 8/2001 |
| JP | 2002-104435 | 4/2002 |

* cited by examiner

*Primary Examiner*—Jes F. Pascua
(74) *Attorney, Agent, or Firm*—Armstrong Teasdale LLP

(57) ABSTRACT

A plastic valve bag construction is provided having structure enabling positive closure of the outer opening of the valve, once filling of the bag has been completed. Closure is provided by the placement of adhesive on one or more regions adjacent the outer opening of the valve which one or more regions of adhesive are covered by a removable shield. A method for making such plastic valve bags is also disclosed.

6 Claims, 7 Drawing Sheets

TYPICAL VALVE BAG MACHINE WITH LABEL (PATCH) APPLICATOR FOR POSITIVE CLOSURE

POSITIVE VALVE CLOSURE FOR PLASTIC-LINED BAGS AND METHOD FOR MAKING SAME

BACKGROUND OF THE INVENTION

1. Field of the Invention

The present invention relates to plastic valve bags, which may or may not have outer paper surrounding bag structures, for the containment of particulate materials.

2. The Prior Art

A plastic valve sack/bag is produced by forming specially formulated plastic sheet (film) over a series of folding frames to create the desired bag configuration. Heat seals are made using hot metal sealing bars at both the end of the bag to create a bottom seal and in the face of the bag using a U sealer to create the valve opening. An anti-sift flap is provided in the valve opening area to discourage the sifting of product from the bag. Air is vented from the customer filled bag through both the valve opening and through a series of paths created by the unique U seal configuration. In addition, the bag, if of the multi-layer style, may be provided with pluralities of small holes that are misaligned, from layer to layer, to likewise permit air escape, but prevent sifting, in view of the tortuous path the particles would have to take from the interior, through the several layers, to the outside. During air evacuation and subsequent transportation/storage the filled product (typically solid particulate material) can sift out through the valve opening. This is an undesirable effect for several reasons including economic loss (loss of product), environmental (product spills into the environment), safety (potential slipping or contamination hazard), and aesthetics where many retailers do not want their store floors covered with leaking product.

Bags having internal anti-sift flaps are known. Examples of such bags, which are provided with paper outer structures, are shown in U.S. Pat. Nos. 5,516,210; 5,806,982; and 6,092,930. In these references, bags are shown having internal anti-sift flaps associated with valve tube structures not formed as part of the bags, per se. These valve tube structures are located in the top (or bottom) end regions of the bags, with portions of the valve tubes extending outwardly from a front (short) wall of the bag. The valve tubes have outer support portions fabricated from paper, with sealable plastic liner portions. Positive sealing of the outwardly extending portions of the valve tubes is accomplished by heat or ultrasonic sealing.

However, such sealing techniques are difficult or not possible, when no outwardly projecting valve tube is provided, or when the bag is fabricated in its entirety from plastic (which may not be of a kind that is amenable to heat or ultrasonic sealing), or when the valve is located in a position away from a peripheral "edge" region of a bag.

For example, valve bags, fabricated entirely from plastic are known, wherein the valves are located in a face (large area side) of a bag, at a location away from the top, end or side edges of the face, in a region where there is the edges of the tube forming the bag overlap, the valve being formed essentially as a gap in the seal that forms the bag.

It is desirable to provide a structure that provides for the positive sealing of such a valve bag, after filling, to substantially or entirely preclude sifting of product from the bag.

It is also desirable to provide a method for positive sealing of such valve bags, that does not require the external application of energy such as heat or ultrasonic vibrations.

These and other desirable characteristics of the present invention will become apparent in view of the present specification and drawings.

SUMMARY OF THE INVENTION

The invention comprises, in part, a positive sealing apparatus, in combination with a valve bag, wherein the valve bag has a tubular body, with an outer lap overlying an inner lap with a seal extending longitudinally therebetween, the valve bag having a valve opening formed by a gap in the longitudinal seal, the valve bag further having portions of the outer and inner laps disposed adjacent and to the outside of the valve opening.

The positive sealing apparatus comprises a valve seal liner, disposed in juxtaposed overlying relation to at least one of the portions of the outer and inner laps disposed adjacent and to the outside of the valve opening. At least one strip of adhesive material is disposed between the valve seal liner and the at least one of the portions of the outer and inner laps disposed adjacent and to the outside of the valve opening. The adhesive material has a first adhesive affinity for the material from which the bag is fabricated, and a second adhesive affinity for the material from which the valve seal liner is fabricated, the first adhesive affinity being greater than the second adhesive affinity, whereupon removal of the valve seal liner, the adhesive remains on the at least one of the outer lap and the inner lap, and further upon pressing of the outer lap against the inner lap, the outer lap and inner lap are adhered to one another, the at least one strip of adhesive material being located so as to completely seal a region between the outer and inner laps that completely surrounds the valve opening of the bag, for creating a positive seal, toward precluding undesired escape of material contained within the bag.

In a preferred embodiment of the invention, the valve seal liner further comprises a first portion disposed in juxtaposed overlying relation to the portion of the outer lap disposed adjacent and to the outside of the valve opening and a second portion disposed in juxtaposed overlying relation to the portion of the inner lap disposed adjacent and to the outside of the valve opening, so that the valve seal liner extends across the valve opening, along a distance greater than a length of the valve opening. Preferably, the at least one strip of adhesive material comprises a first strip of adhesive material disposed between the first portion of the valve seal liner and the portion of the outer lap disposed adjacent and to the outside of the valve opening, and a second strip of adhesive material disposed between the second portion of the valve seal liner and the portion of the inner lap disposed adjacent and to the outside of the valve opening. Preferably, the valve seal liner further comprises a perforation line extending at least partially between the first and second portions of the valve seal liner, the perforation line being substantially aligned with the valve opening of the valve bag, the perforation line being configured to be breached by a filling nozzle of a filling apparatus to permit entry of the filling nozzle into the valve, to provide access into an interior region of the valve bag.

Alternatively, the valve seal liner may further comprise a single portion disposed in one of juxtaposed overlying relation to the portion of the outer lap disposed adjacent and to the outside of the valve opening, and juxtaposed overlying relation to the portion of the inner lap disposed adjacent and to the outside of the valve opening. The at least one strip of adhesive material may comprise a single strip of adhesive material disposed between one of the first portion of the valve seal liner and the portion of the outer lap disposed adjacent and to the outside of the valve opening, and the second portion of the valve seal liner and the portion of the inner lap disposed adjacent and to the outside of the valve opening.

In an embodiment of the invention, the valve seal liner extends substantially from a top end of the bag to a bottom end of the bag.

Preferably, the valve seal liner comprises a sheet of siliconized plastic material. The plastic material is preferably one of: high density polyethylene, polyester, polypropylene. The at least one strip of adhesive material is preferably fabricated from a synthetic rubber material.

The invention also comprises, in part, a method for making a positive seal apparatus for a valve bag, wherein the valve bag has a tubular body, with an outer lap overlying an inner lap with a seal extending longitudinally therebetween, the valve bag having a valve opening formed by a gap in the longitudinal seal, the valve bag further having portions of the outer and inner laps disposed adjacent and to the outside of the valve opening, the method comprising the steps of:

forming the positive seal apparatus with a valve seal liner and at least one strip of adhesive material by disposing the valve seal liner in juxtaposed overlying relation to at least one of the portions of the outer and inner laps disposed adjacent and to the outside of the valve opening, disposing the at least one strip of adhesive material between the valve seal liner and the at least one of the portions of the outer and inner laps disposed adjacent and to the outside of the valve opening, providing the adhesive with a first adhesive affinity for the material from which the bag is fabricated, and a second adhesive affinity for the material from which the valve seal liner is fabricated, the first adhesive affinity being greater than the second adhesive affinity, whereupon removal of the valve seal liner, the adhesive material remains on the at least one of the outer lap and the inner lap, and further upon pressing of the outer lap against the inner lap, the outer lap and inner lap are adhered to one another, locating the at least one strip of adhesive material so as to completely seal a region between the outer and inner laps that completely surrounds the valve opening of the bag, for creating a positive seal, toward precluding undesired escape of material contained within the bag.

Preferably, the method further comprises the steps of:

providing the valve seal liner with a first portion and a second portion, disposing the first portion in juxtaposed overlying relation to the portion of the outer lap disposed adjacent and to the outside of the valve opening, disposing the second portion in juxtaposed overlying relation to the portion of the inner lap disposed adjacent and to the outside of the valve opening, so that the valve seal liner extends across the valve opening, along a distance greater than a length of the valve opening.

The method may further comprise the steps of:

disposing a first strip of adhesive material between the first portion of the valve seal liner and the portion of the outer lap disposed adjacent and to the outside of the valve opening, disposing a second strip of adhesive material between the second portion of the valve seal liner and the portion of the inner lap disposed adjacent and to the outside of the valve opening.

The method may further comprise the steps of:

forming a perforation line in the valve seal liner, extending at least partially between the first and second portions of the valve seal liner, aligning the perforation line with the valve opening of the valve bag, configuring the perforation line to be breached by a filling nozzle of a filling apparatus to permit entry of the filling nozzle into the valve, to provide access into an interior region of the valve bag.

In an embodiment of the invention, the method may further comprise the steps of:

forming the valve seal liner further as a single portion;

disposing the single portion in one of juxtaposed overlying relation to the portion of the outer lap disposed adjacent and to the outside of the valve opening, and juxtaposed overlying relation to the portion of the inner lap disposed adjacent and to the outside of the valve opening.

The method may further comprise the steps of:

forming the at least one strip of adhesive material as a single strip of adhesive material;

disposing the single strip of adhesive material between one of the first portion of the valve seal liner and the portion of the outer lap disposed adjacent and to the outside of the valve opening, and the second portion of the valve seal liner and the portion of the inner lap disposed adjacent and to the outside of the valve opening.

The method may further comprise the step of:

forming the valve seal liner so that it extends substantially from a top end of the bag to a bottom end of the bag.

The method preferably further comprises the step of forming the valve seal liner as a sheet of siliconized plastic material. The plastic material may be formed from one of: high density polyethylene, polyester, polypropylene.

The method may further comprise the step of fabricating the at least one strip of adhesive material from a synthetic rubber material.

In an alternative embodiment of the invention, the steps of forming the positive seal apparatus with a valve seal liner and at least one strip of adhesive material by disposing the valve seal liner in juxtaposed overlying relation to at least one of the portions of the outer and inner laps disposed adjacent and to the outside of the valve opening, disposing the at least one strip of adhesive material between the valve seal liner and the at least one of the portions of the outer and inner laps disposed adjacent and to the outside of the valve opening, may further comprise the steps of:

providing a continuous web of carrier material;

applying at least one strip of adhesive material to successive ones of valve seal liners;

placing at least one valve seal liner on the continuous web of carrier material, with the at least one strip of adhesive material disposed between the valve seal liner and the web of carrier material, to form at least one positive seal apparatus disposed on the web of carrier material.

The method may further comprise the step of:

forming at least one valve bag from a continuous web of bag material;

transferring the successive positive seal apparatus from the web of carrier material to the web of bag material.

Alternatively, the steps of forming the positive seal apparatus with a valve seal liner and at least one strip of adhesive material by disposing the valve seal liner in juxtaposed overlying relation to at least one of the portions of the outer and inner laps disposed adjacent and to the outside of the valve opening, disposing the at least one strip of adhesive material between the valve seal liner and the at least one of the portions of the outer and inner laps disposed adjacent and to the outside of the valve opening, may further comprise the steps of:

forming at least one valve bag from a continuous web of bag material;

applying the at least one strip of adhesive material directly to the continuous web of bag material;

positioning the valve seal liner on the continuous web of bag material, in juxtaposed overlying relation to the at least one strip of adhesive material.

DETAILED DESCRIPTION OF THE DRAWINGS

Figure 1:
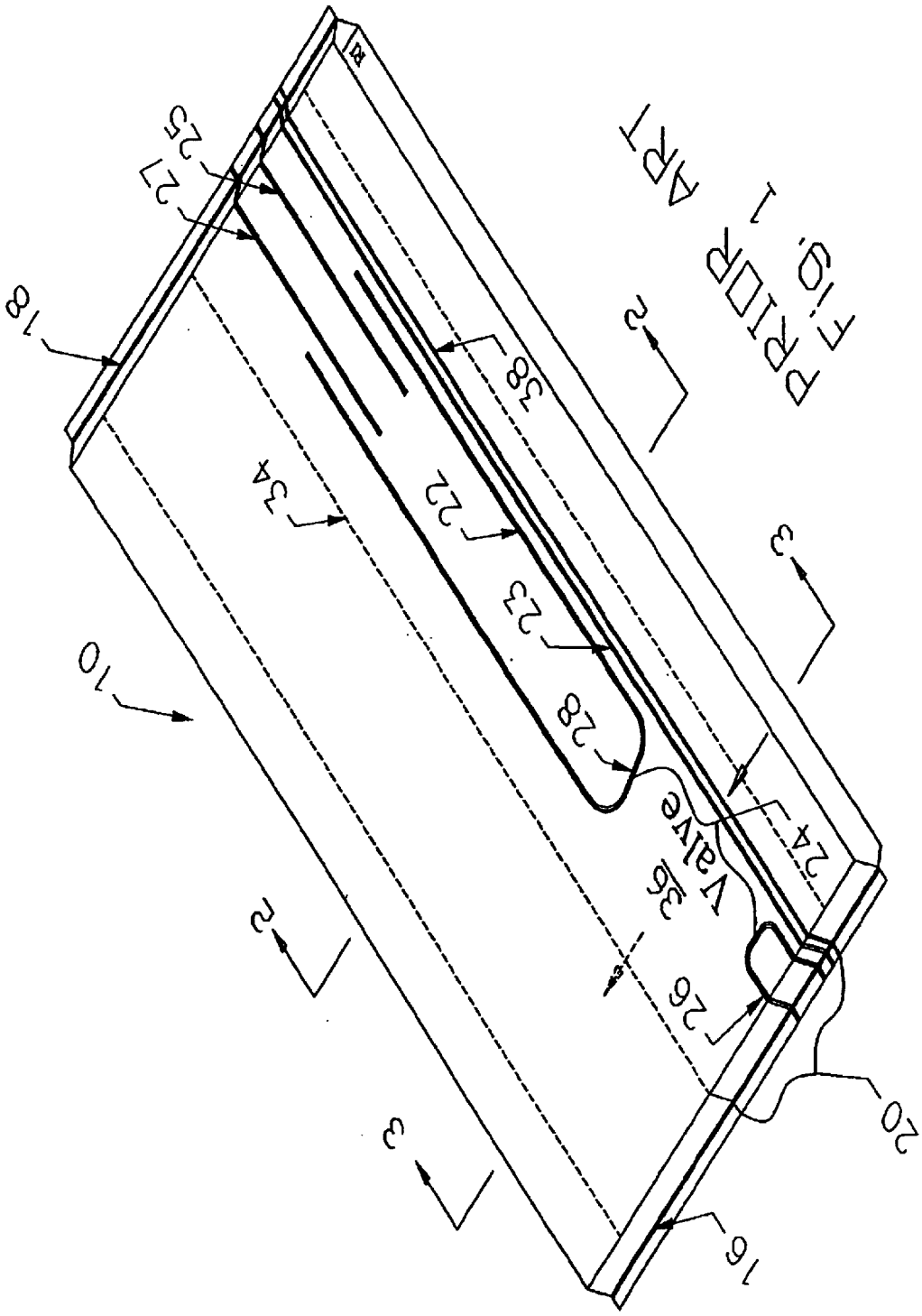
FIG. 1 PRIOR ART
FIG. 1 is a front face elevation of a prior art all-plastic valve bag.

While this invention is susceptible of embodiment in many different forms, there are shown in the drawings and will be described in detail, several specific embodiments, with the understanding that the present disclosure is to be considered as an exemplification of the principles of the invention and is not intended to limit the invention to the embodiments illustrated.

Figure 2:
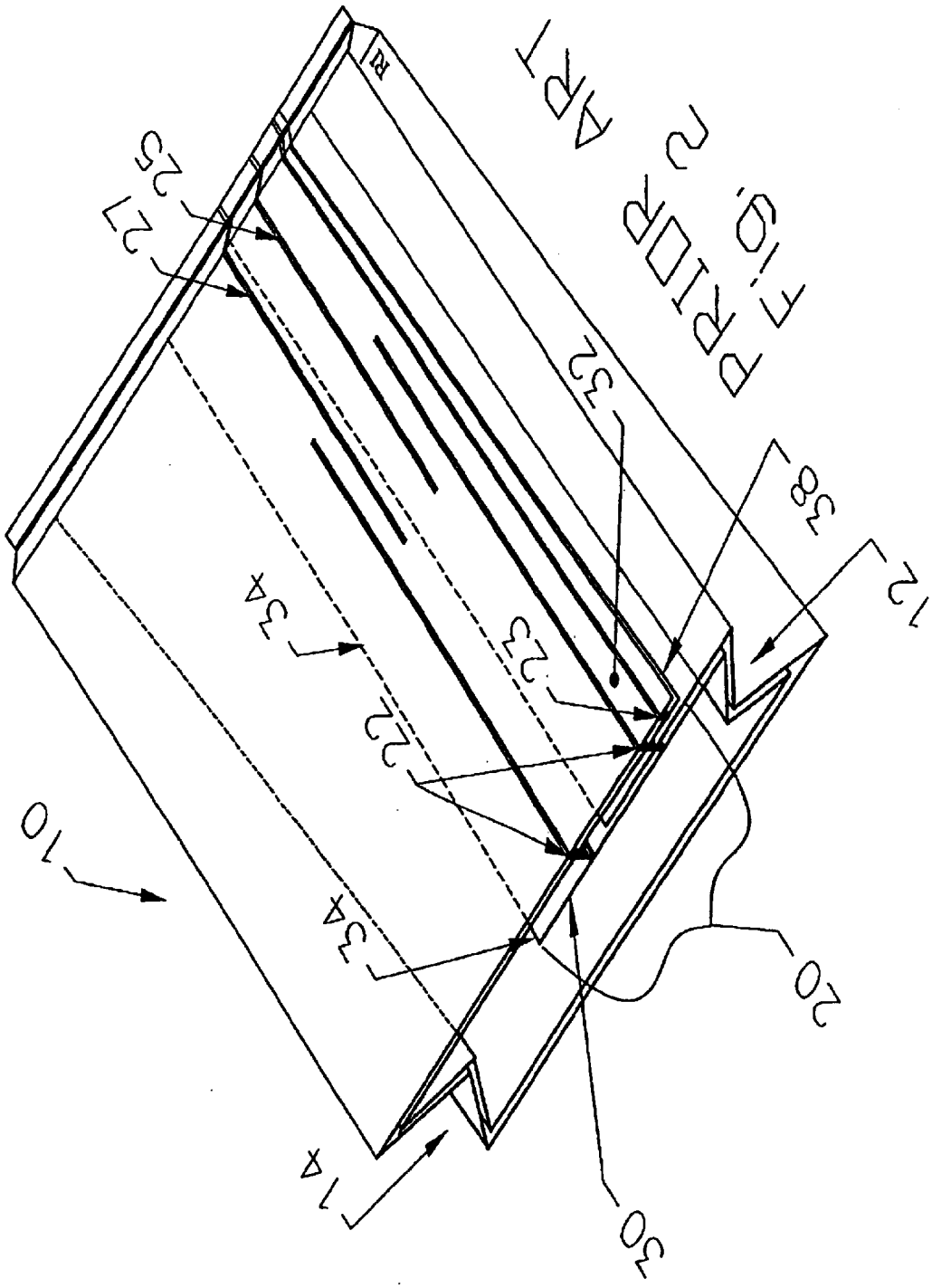
FIG. 2 PRIOR ART
FIG. 2 is a top sectional view of the bag of FIG. 1, taken along line 2—2 of FIG. 1.
Figure 3:
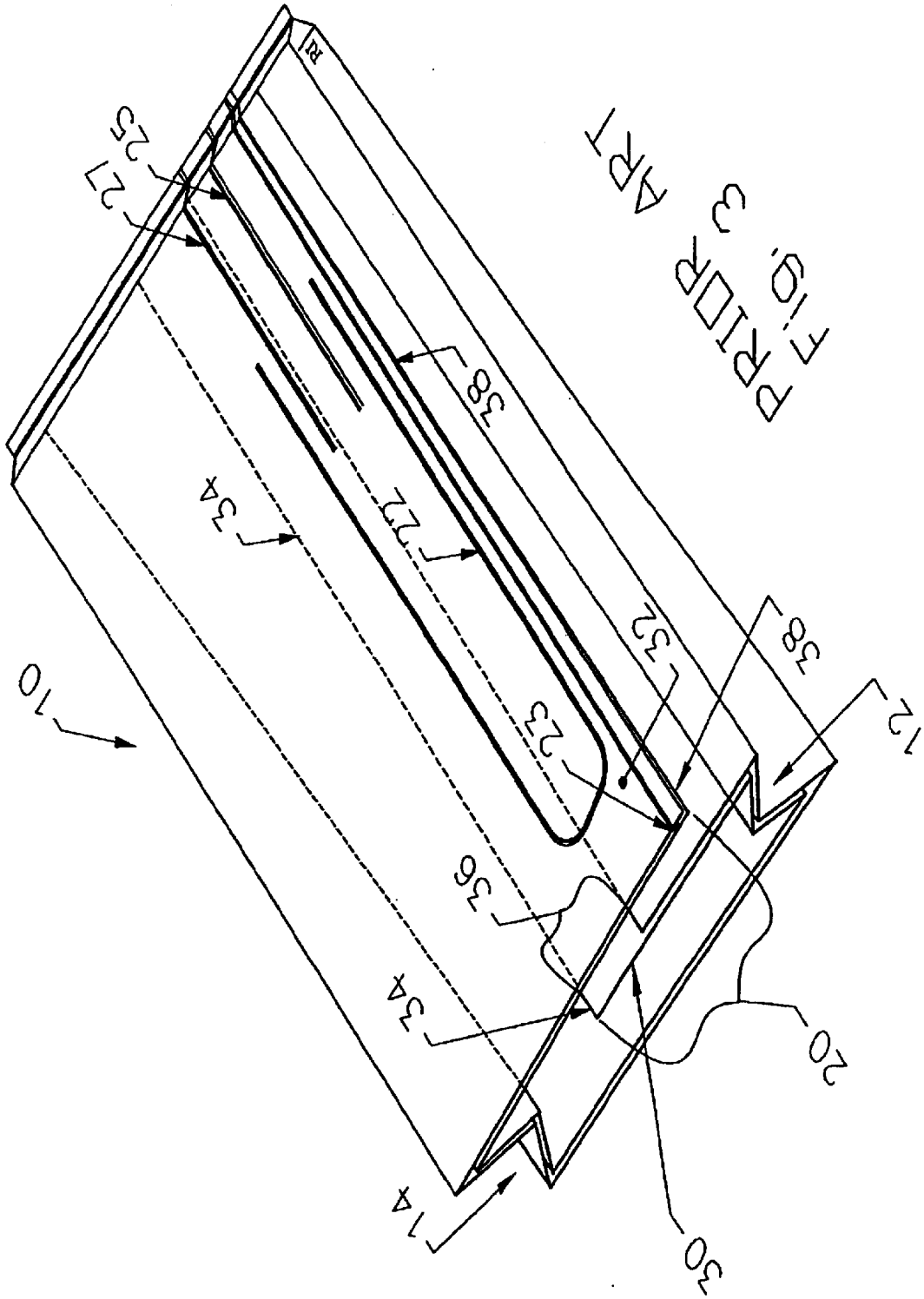
PRIOR ART FIG. 3
FIG. 3 is a top sectional view of the bag of FIG. 1, taken along line 3—3 of FIG. 1.
Figures 4, 5, 6, 7:
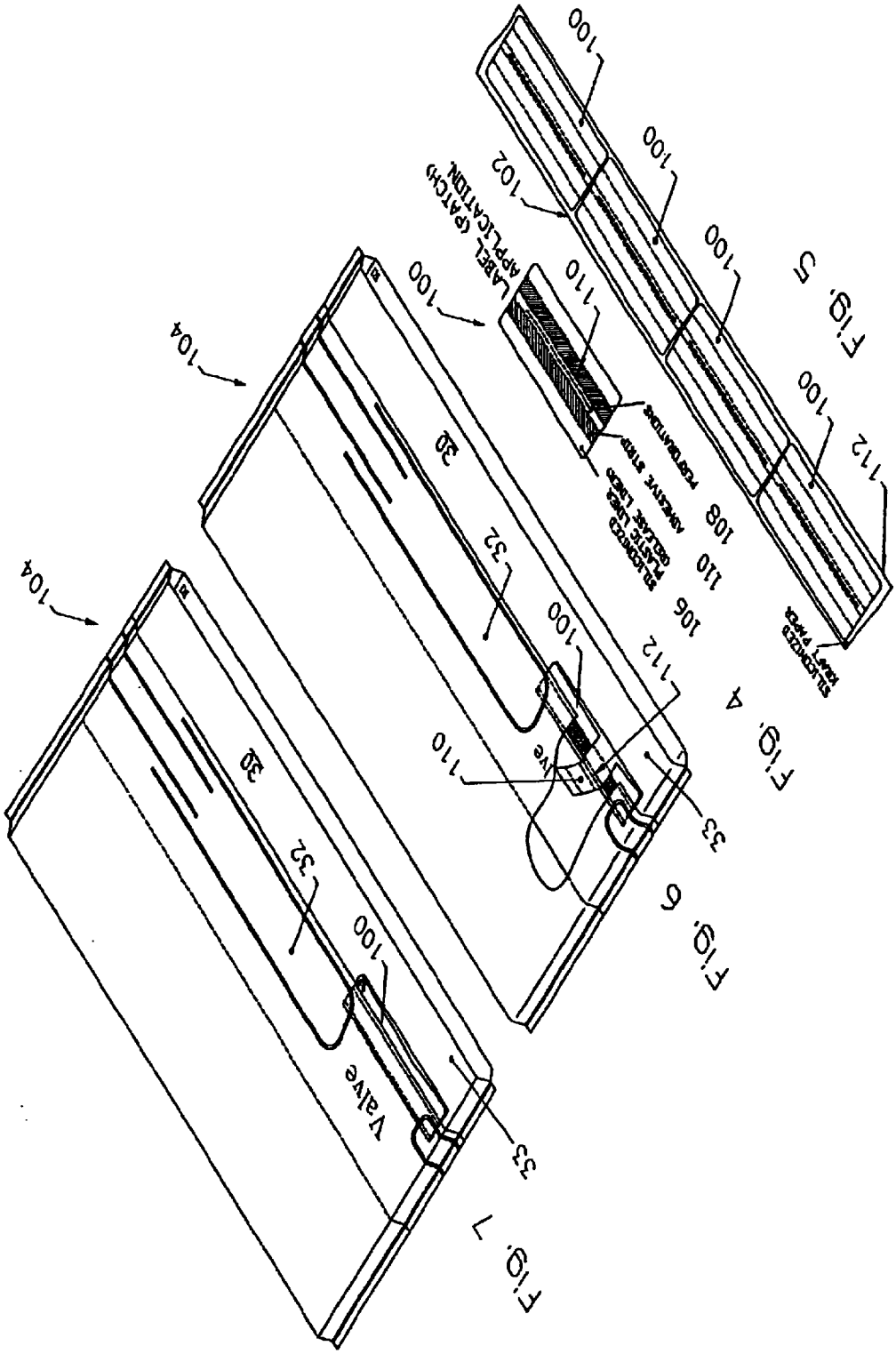
FIG. 4 is a perspective view of a single valve closure label, according to a preferred embodiment of the invention.
FIG. 5 is a perspective view of a portion of a web bearing successive ones of valve closure labels, according to the embodiment of FIG. 4.
FIG. 6 is a perspective view of a bag incorporating a valve closure label, according to the embodiment of FIGS. 4 and 5, showing a portion of the valve region in section, with a sectioned portion of the label shown in a partially unfolded orientation.
FIG. 7 is a perspective view of a bag incorporating a valve closure label, according to the embodiment of FIGS. 4–6.

FIG. 1 is a front face elevation of a prior art all-plastic valve bag. FIG. 2 is a top sectional view of the bag of FIG. 1, taken along line 2—2 of FIG. 1. FIG. 3 is a top sectional view of the bag of FIG. 1, taken along line 3—3 of FIG. 1. Bag 10 is illustrated, for simplicity, as being two layers thick (of plastic material), but it is understood that greater or fewer numbers of layers may be provided. Bag 10 is tubular in form, and may be provided with inwardly projecting side gussets 12, 14. Bag 10 is further preferably closed by seams 16, 18 at its top and bottom edges, which seams capture not only the front (visible) and rear face top and bottom edges, but also the top and bottom edges of gussets 12, 14. Bag 10 further includes, in its face, a region of overlap 20, that extends from top to bottom.

Closure of bag 10 in the front face is provided by seam 22 which extends from the top of bag 10 toward the bottom, with an interruption 24, where the valve is located. Seam 22 typically stops short of the bottom. Two other seams 25, 27, which only join the two layers of the outer lap 32, extend in parallel upwardly from the bottom seam 18. Interruption 24 is defined by seam 26, which in a preferred embodiment of the invention extends horizontally for a short distance and then turns toward and extends completely to the seam 16 (although it could extend straight horizontally if so desired), and seam 28 which extends further horizontally, before turning down toward the bottom of the bag, which join inner lap 30 to outer lap 32, from seam 22. The valve region is further defined by inner edge 34 of inner lap 30. The portion of inner lap 30 that is bounded by seams 26, 28, forms the inner anti-sift flap 36. Seam 22 joins together all four layers of inner lap 30 and outer lap 32. Seam 23 joins together the two layers of outer lap 32, adjacent edge 38 thereof.

To fill bag 10, a filling nozzle (not shown) is inserted into gap 24, between inner lap 30 and outer lap 32, until it passes edge 34 to access the interior of the bag. After filling is completed, and the nozzle is removed, when the bag is laid on its side, the material in the bag will tend to exert an outward force on anti-sift flap 36 to move it against outer lap 32. However, while this is occurring, and even afterward, because there is no positive closure along gap 24, product can be puffed out of the bag and/or gradually sift out, during transportation.

In order to address this problem, it has been contemplated to apply adhesive to the juxtaposed surfaces of inner lap 30 and outer lap 32, in the region of gap 24, immediately before filling, or just after removal of the filling nozzle. However, application of adhesive prior to filling can complicate the filling procedure by requiring measures in which the adhesive is avoided. Application of adhesive just after filling can likewise be problematic in that, in some situations, the product may be small size particulate material, which can readily become airborne during and after the filling process. Such flying particulate material can interfere with the lay-down of the adhesive material, and/or can become captured by the laid down adhesive, adversely impacting the performance of the adhesive.

The present invention is directed to a manner of providing an adhesive, positive closure of a valve bag, which provides for ease of filling of the bag, ease of placement of the adhesive, and protection of the adhesive until the appropriate time in the filling process for sealing the bag.

The present invention is provided in two related embodiments. The first embodiment is directed to small size particulate product applications (e.g., for powder, 5–200 μm (micrometers)), in which, as indicated above, the individual particles are highly mobile and easily made airborne and migratory, during the filling process. As such, the particles can clog unprotected adhesive, and can contaminate and cling to exposed facing surfaces of the inner and outer laps of a plastic valve bag, through either static cling or other well-known small size particle mechanics.

Therefore, to provide a closure for such an application, during the process of fabricating the bag, strips of adhesive material are applied on both sides of the opening defined by the gap in the vertical seal joining the inner and outer laps of the bag, and the adhesive must be shielded during the filling process to prevent the build up of product on the adhesive strips.

The positive valve closure of the present invention accomplishes both of these objectives and allows for the packaging of small particle size materials without the subsequent loss of material through the valve opening after the filling process.

The positive closure feature can be incorporated into a standard plastic valve bag, such as that shown in FIGS. 1–3, either by applying a "label" to the valve opening only or by applying a continuous strip along the whole length of the bag including the valve opening. In both cases, the design of the applied substrate of the label is the same although the shape (length, width, thickness) and the application method may differ.

In preferred embodiments of the invention, the label or strip is a three-layer product provided with differential release properties that allow the adhesive to be preferentially transferred from one layer to the other and from the label itself to the valve opening in the bag. The label or strip is comprised of an outer layer of (preferably) 2.5 mil thick siliconized Kraft paper, a middle adhesive layer and an inner layer of siliconized plastic liner. The adhesive must have good tack adhesive properties, must provide good adhesion to a wide variety of surfaces and should have an application temperature range between 5° C. and 80° C. One such preferred adhesive is sold under the trademark Kraton® by Shell Oil Company, but other synthetic rubber based materials meeting the aforementioned technical requirements may be employed, such as pressure sensitive adhesives (rubber based mats). The plastic layer is approximately three (3) mil thick and can be made of one of several different types of materials including high density polyethylene, polyester and polypropylene. The plastic liner is treated with a release agent, such as silicone, to enable preferential transfer of the adhesive to the areas of the inner and outer laps, adjacent the gap in the vertical seam between the inner and outer laps, once the plastic liner is removed.

The plastic layer of the label or strip is perforated down the center of its length with the exception of preferably 0.25 to 2.00 inches at each of the upper and lower ends of the plastic layer. This perforation allows the plastic layer of the label or strip to behave as a single component during the application process and subsequently to behave as two separate opposing layers once the perforated area has been breached (as described further hereinafter) and the film has been folded onto itself. This functionality allows the mechanization of the label application process, while allowing for the closure to be one of adhesive against adhesive. The ends of the label or strip are not perforated to allow for the removal of both sides of the label (post perforated area breach) with a single pulling motion.

FIGS. 4–7 illustrate positive valve closure label 100, a web 102 of labels 100, and bags 104 incorporating labels 100. Each label 100 includes a release liner 106, preferably fabricated from a siliconized plastic material, into which a perforation line 108 has been formed, extending down a centerline of the liner, but not to the ends, as previously described. Two adhesive strips 110 are applied to liner 106, to either side of perforation line 108. The application of labels 100 is via a web 102, which comprises a plurality of labels 100 laid (adhesive side down) on a continuous strip 112 of siliconized Kraft paper.

When each label 100 is applied to each section of film which is being folded into a bag 104, in the manner generally described herein, at the moment of application of the label, outer lap 32 of each bag 104 is essentially folded back upon itself, to lie essentially over inner lap 30, the inside surface of outer lap 32 being on one side of the slit defining the outer opening of the valve, and a portion 33 of inner lap 30 being on the other side of the slit defining the outer opening of the valve. Each label 100 is thus laid, in a flat condition, onto the valve opening region, with the perforation line 108 being substantially aligned with and overlying the slit defining the outer opening of the valve. In the process of completing the folding of the film to form the bag, outer lap 32 is folded outward to its orientation shown in FIGS. 4 and 5, with the result that each label 100 is folded over upon itself, the fold line taking form along perforation line 108.

Figure 11:
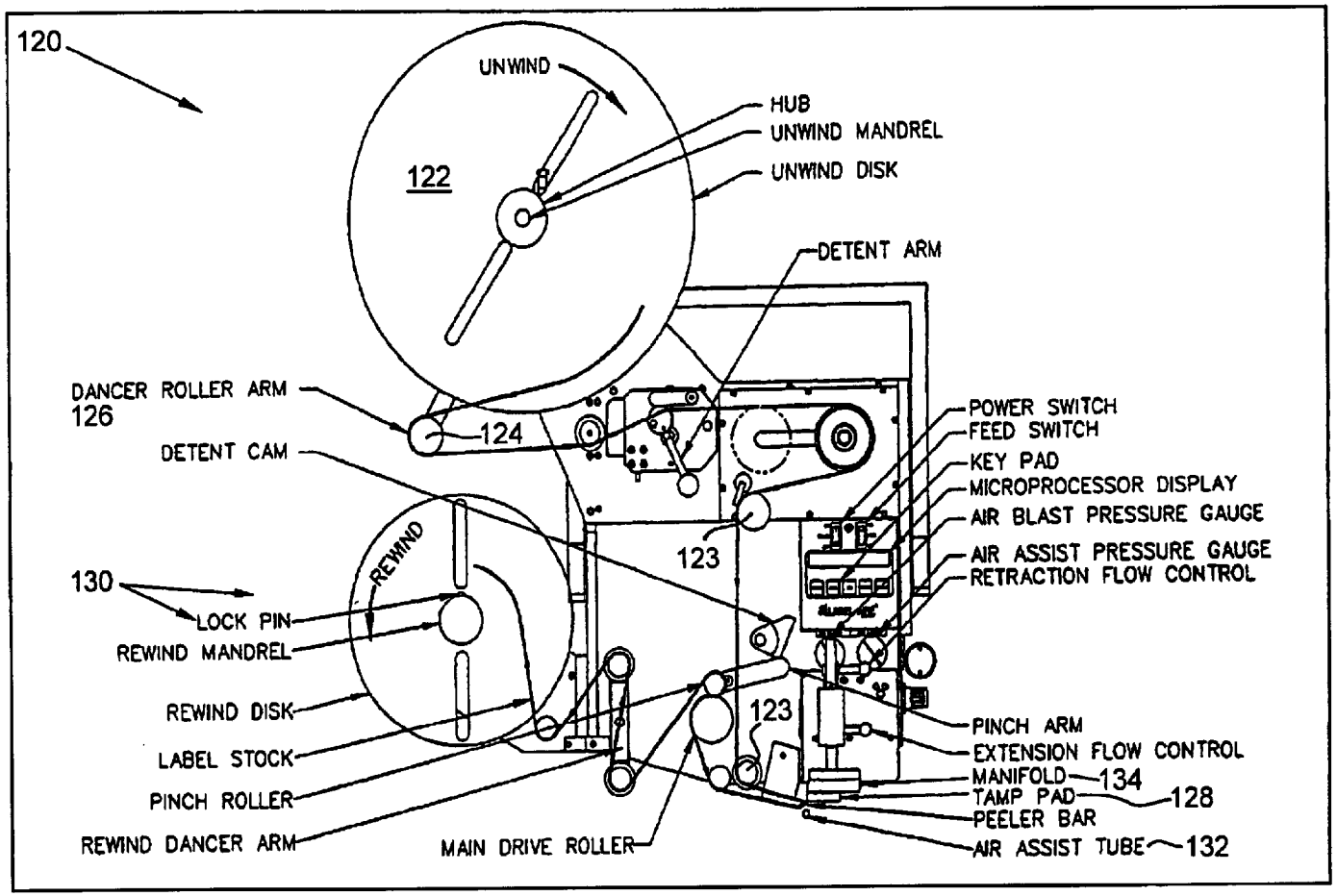
FIG. 11 is a side elevation of a typical label applying apparatus, for using in applying labels, in accordance with the valve bag with positive valve closure according to the embodiment of FIGS. 4–7.
Figure 12:
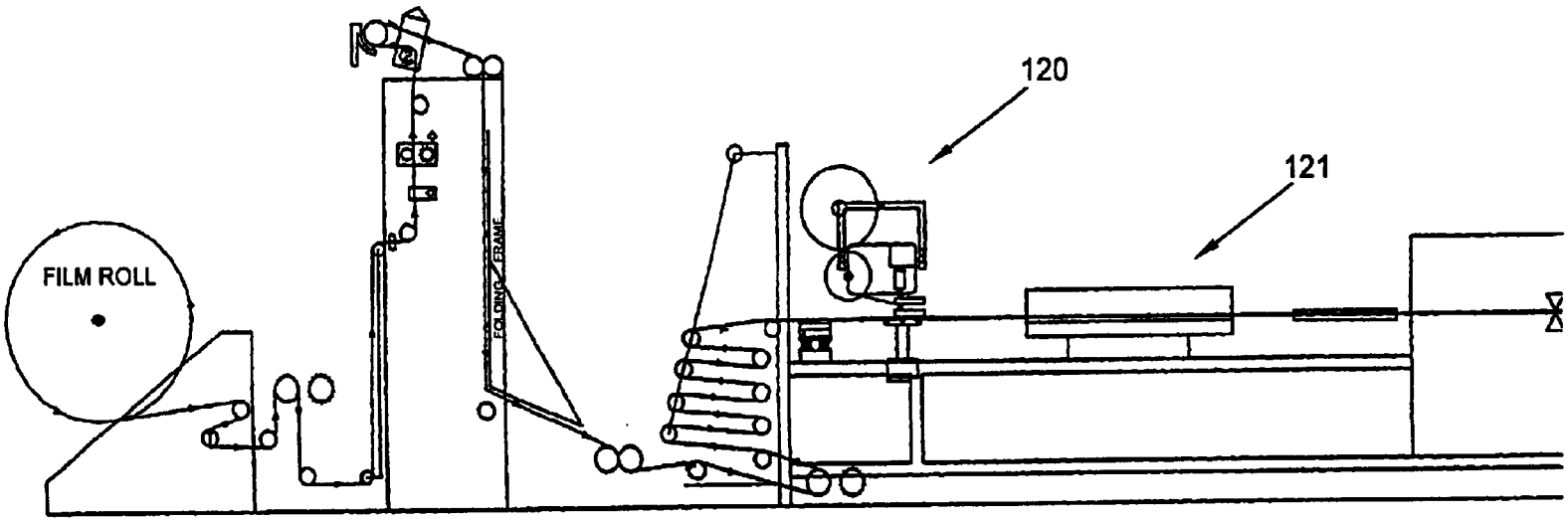
FIG. 12 is a simplified side elevation of a typical valve bag machine with label applicator for applying positive closure labels, in accordance with the embodiment of FIGS. 4–7 and 11.

The labels 100 are applied to the valve opening of the bag using a conventional label dispensing unit 120, shown in FIGS. 11 and 12. Typically a roll of labels containing as many as 10,000 labels is mounted on the unwind reel 122 of the label dispenser 120. The web 102 travels through a series of idler wheels 123 and a dancer roller 124, on dancer roller arm 126 which control the tension of the web. As the web 102 approaches a tamping device 128 that is used to affix the plastic portions of the label 100 to the valve openings on the bags 104, the Kraft paper portion 112 of the web 102 is removed using another winding mechanism 130 that continuously pulls the Kraft paper 112 away from the remaining plastic label 100. During this procedure, the adhesive strips 110 preferentially transfer over to the underside of the plastic layer 106 of each individual label 100. The remaining individual plastic label 100 is pushed upward onto the tamp pad 128 using an air assist bar 132 while at the same time a vacuum through manifold 134 draws and hold the upper (non-adhesive) side of the plastic label 100 onto the tamp pad 128. The tamping device is synchronized with the rest of the bag making process so as to both tamp and blow the label 100 onto the valve opening area of the film (bag) 104. The label 100 adheres to the film (bag) 104 due to the adhesive strips 106 on the underside of the plastic label 100. This process occurs at the time that the film web 104 has stopped on the bag machine carriage to perform the seal operations at sealing station 121 to create the seals described hereinabove. The lip of the valve opening is subsequently folded over as is the label 100 itself.

Figures 8, 9, 10:
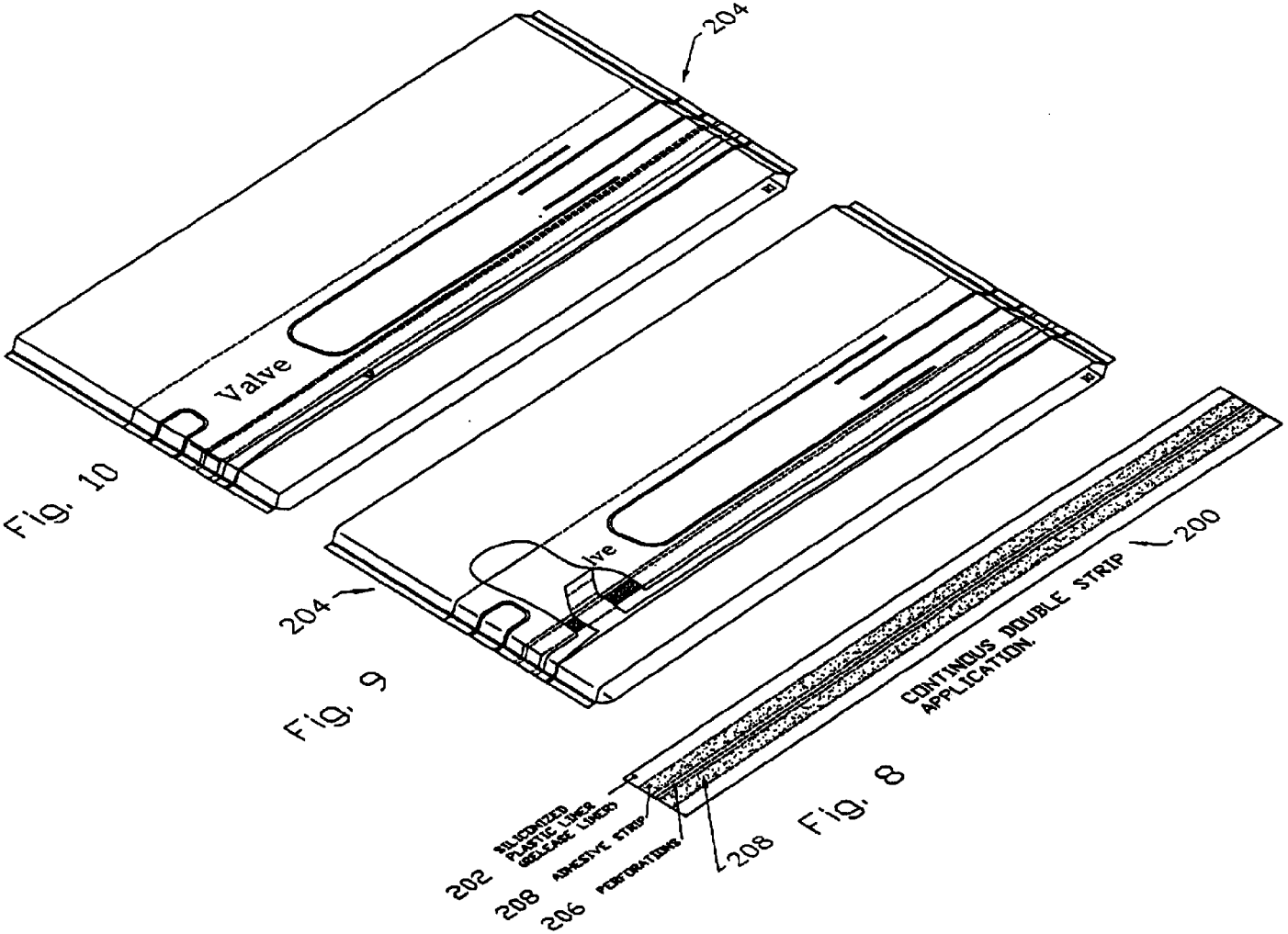
FIG. 8 is a perspective view of a bag incorporating a valve closure strip, according to another alternative embodiment of the invention.
FIG. 9 is a perspective view of a bag incorporating a valve closure strip, according to the embodiment of FIG. 8, showing a portion of the valve region in section, with a sectioned portion of the strip shown in a partially unfolded orientation.
FIG. 10 is a perspective view of a bag incorporating a valve closure strip, according to the embodiment of FIGS. 8 and 9.

In the alternative embodiment (FIGS. 8–10) in which the positive closure structure is in the form of a full-length strip 200, the strip 200 is applied to the full length of the bag 204, including the valve opening. Each strip comprises a siliconized plastic liner 202, with a perforation line 206, and two parallel adhesive strips 208. The strips 200 are preferably supplied on a large roll than can contain the equivalent of up to 5,000 individual strips 200. The roll is mounted on the unwind reel of a strip dispensing machine (similar but suitably differently proportioned to dispensing machine 120) where it travels through a similar series of idler wheels to control tension. As the film/bag moves along the bag machine carriage the leading edge of the plastic strip is continuously pressed lightly against the edge of the full length of the film/bag usually 1' to 2' from the outside edge, but always centered on the valve opening. The plastic strip is essentially wiped onto the film/bag using the motion of the film/bag on the bag machine carriage to control the application rate and relying on the adhesive to ensure that it stays in place. When the film motion on the bag machine is stopped to both apply the necessary seals and to cut the film into individual bags, the application of the strip ceases accordingly. The sealer bars of the bag machine seal through both the film and the plastic strip and the cutting knives cut through both the film and the plastic strip, resulting in an individual bag with a plastic strip along the full length of the bag including in the valve opening area.

A bag with a positive closure device according to the present invention is typically filled and closed using a manual operation. The bag is lifted into position by an operator, where the filling spout is used to puncture the perforation in the valve opening area. The filling spout is inserted into the valve opening and the small particle size material is blown into the bag until the desired weight is obtained. The spout is removed and the operator grasps the plastic label or strip from one end, pulling in one motion to remove the entire label or strip. The adhesive is this time preferentially transferred over to the plastic bag, exposing the two layers of non-contaminated adhesive directly opposite each other. The operator then presses the two layers together, closing the valve opening and creating a positive closure.

The procedure for creating a positive closure structure for bags intended for relatively large particle size materials (e.g., over 200 $\mu$m (micrometers)—granular) is similar to the just-described procedure for creating positive closure structures for bags intended for small particle size materials, except that a single adhesive strip can be laid down along one side of the valve opening, to effectively close the valve opening. Because of the relatively large size of the particles, the particles are less likely to become airborne, if airborne will settle more quickly, and will have less tendency to be dusted onto and cling to the sides of the valve opening, so there is less likelihood of contamination of the sides of the valve opening. Thus, positive closure can be achieved by applying the adhesive to only one side of the valve opening and subsequently closing the bag after filling by pressing the sides of the opening together. In this embodiment, closure is achieved through adhesive/bag film interaction, instead of adhesive/adhesive interaction used for bags for small particle size materials. The label or strip design is preferably substantially the same as that for the first described embodiment, except that the strips can be smaller in width and need only be applied to one side of the valve opening. Thus, the perforation feature is likewise absent.

In a further alternative embodiment of the invention, the adhesive can be applied directly to the bag film, via a hot melt adhesive application system. During this process, the adhesive is melted in a small extruder and applied to either one side (large particle size applications) or to both sides (small particle size applications) of the valve opening, using a spray applicator. Upon application of the adhesive to the film surface, the adhesive solidifies and is simultaneously covered with a plastic label or strip to prevent exposure and contamination. In this embodiment, the configuration of the label or strip is more simplified as there is no adhesive present and therefore no need for the use of Kraft paper to prevent the adhesive material from sticking to itself while in roll form. The label or strip is therefore preferably comprised of just the siliconized plastic (preferably 3 mil high density polyethylene, polyester, polypropylene, etc.) and has the characteristics necessary to cover the adhesive once applied to the bag and to provide the preferential transfer of adhesive to the film in the valve opening once the label or strip is removed after filling. The label or strip application and closing mechanism for the bag after filling may be exactly the same as described with the two previously described embodiments.

The foregoing description and drawings merely explain and illustrate the invention and the invention is not limited thereto, as those skilled in the art who have the disclosure before them will be able to make modifications and variations therein without departing from the scope of the invention.

What is claimed is:

1. A positive sealing apparatus, in combination with a valve bag, wherein the valve bag has a tubular body, with an outer lap overlying an inner lap with a seal extending longitudinally therebetween, the valve bag having a valve opening formed by a gap in the longitudinal seal, the valve bag further having portions of the outer and inner laps disposed adjacent and to the outside of the valve opening, the positive sealing apparatus comprising:

a valve seal liner, disposed in juxtaposed overlying relation to at least one of the portions of the outer and inner laps disposed adjacent and to the outside of the valve opening, at least one strip of adhesive material, disposed between the valve seal liner and the at least one of the portions of the outer and inner laps disposed adjacent and to the outside of the valve opening, the adhesive having a first adhesive affinity for the material from which the bag is fabricated, and a second adhesive affinity for the material from which the valve seal liner is fabricated, the first adhesive affinity being greater than the second adhesive affinity, whereupon removal of the valve seal liner, the adhesive remains on the at least one of the outer lap and the inner lap, and further upon pressing of the outer lap against the inner lap, the outer lap and inner lap are adhered to one another, the at least one strip of adhesive material being located so as to completely seal a region between the outer and inner laps that completely surrounds the valve opening of the bag, for creating a positive seal, toward precluding undesired escape of material contained within the bag said valve seal liner further comprising a first portion disposed in juxtaposed overlying relation to the portion of the outer lap disposed adjacent and to the outside of the valve opening and a second portion disposed in juxtaposed overlying relation to the portion of the inner lap disposed adjacent and to the outside of the valve opening, so that the valve seal liner extends across the valve opening, along a distance greater than a length of the valve opening.

2. The positive sealing apparatus according to claim 1, wherein the at least one strip of adhesive material comprises a first strip of adhesive material disposed between the first portion of the valve seal liner and the portion of the outer lap disposed adjacent and to the outside of the valve opening, and a second strip of adhesive material disposed between the second portion of the valve seal liner and the portion of the inner lap disposed adjacent and to the outside of the valve opening.

3. The positive sealing apparatus according to claim 1, wherein the valve seal liner comprises a perforation line extending at least partially between the first and second portions of the valve seal liner, the perforation line being substantially aligned with the valve opening of the valve bag, the perforation line being configured to be breached by a filling nozzle of a filling apparatus to permit entry of the filling nozzle into the valve, to provide access into an interior region of the valve bag.

4. The positive sealing apparatus according to claim 1, wherein the valve seal liner comprises a sheet of siliconized plastic material.

5. The positive sealing apparatus according to claim 4, wherein the plastic material is one of: high density polyethylene, polyester, polypropylene.

6. The positive sealing apparatus according to claim 1, wherein the at least one strip of adhesive material is fabricated from a synthetic rubber material.

* * * * *